US005901726A

United States Patent [19]

Gal et al.

[11] Patent Number: 5,901,726

[45] Date of Patent: May 11, 1999

[54] DEVICE FOR ATTACHING THE END OF A TENT HOOP TO A CANVAS

[75] Inventors: Yann Le Gal, Voreppe; Sébastien Poussielgue, Beaurepaire, both of France

[73] Assignee: Lafuma SA, France

[21] Appl. No.: 09/083,826

[22] Filed: May 22, 1998

[51] Int. Cl.[6] ..... E04H 15/64

[52] U.S. Cl. ..... 135/120.3; 135/120.1; 135/120.4; 135/124

[58] Field of Search ..... 135/120.1, 120.3, 135/120.4, 115, 124, 130, 119; 52/2.25

[56] References Cited

U.S. PATENT DOCUMENTS 1,622,600 3/1927 McHugh ..... 135/120.4

2,186,535 1/1940 McGeorge ..... 135/120.4 X 4,858,635 8/1989 Eppenbach .

FOREIGN PATENT DOCUMENTS 2258666 2/1993 United Kingdom .

*Primary Examiner*—Robert Canfield

*Assistant Examiner*—Phi Dieu Tran A

*Attorney, Agent, or Firm*—Wall Marjama Bilinski & Burr

[57] ABSTRACT

A device for attaching the hollow end of a tent hoop to a canvas of the type that comprises a first strap attached at one end to the canvas and at the other end to a ring; a second strap attached to the same ring to accommodate a peg driven into the ground, and in which said ring comprises at least one pin for engaging in the hollow female end of the hoop wherein said ring includes a V-shaped segment whose vertex is in the vicinity of the center of the ring and whose arms coincide with radii of the hoop.

6 Claims, 4 Drawing Sheets

DEVICE FOR ATTACHING THE END OF A TENT HOOP TO A CANVAS

BACKGROUND OF THE INVENTION

The invention relates to tent canvases and, more particularly, concerns a device for attaching the end of a tent hoop to a canvas.

DESCRIPTION OF THE PRIOR ART

As is known, a tent is a portable temporary shelter generally consisting of a so-called "inner tent" held up by a hoop which may or may not be attached to a ground sheet and sometimes covered by a fly sheet.

In practice, present-day tents generally comprise two intersecting hoops, sometimes indeed with a third independent hoop for the porch. Some versions may even sometimes have more than three hoops.

The problem that arises is how to secure the lower end of the hoop in the ground sheet.

In one approach the end of a hoop includes a male endpiece that fits into an eyelet provided for this purpose in the ground sheet. Although widely used, this approach nonetheless has the disadvantage that the end of the hoop does not sufficiently penetrate the ground sheet. The result is that sometimes the ground sheet slips away from the hoop, which does not then fulfill its functions.

In another approach illustrated in FIG. 1 it has been suggested that use be made of a device comprising a first strap connected to a ring attached to the ground sheet and a second strap connected to the same ring to accommodate a peg driven into the ground. In this approach the ring comprises at least one pin for engaging in the female end of the hoop. This approach ensures that the tent is satisfactorily secured. However, as the pins can move freely around the ring, their orientation is imprecise and unpredictable. The result is twisting of the strap, which is no longer flat on the ground: this causes the hoop to tilt and detracts from stability and appearance.

SUMMARY OF THE INVENTION

The invention relates to a device of the type in question for attaching the hollow end of a tent hoop to a canvas, such as for example an inner or outer tent or a ground sheet, that is easy to manufacture, that enables appropriate orientation of the pins with respect to the hoop, without interference between the pins and without causing the straps to become twisted, and that holds the pins securely when erected.

This device for attaching the end of a tent hoop to a canvas, of the type that comprises:

- a first strap attached at one end to the canvas and at the other end to a ring;
- a second strap attached to the same ring to accommodate a peg driven into the ground;
- and in which said ring comprises at least one pin for engaging in the hollow female end of the hoop, is one wherein said ring includes a V-shaped segment whose vertex is in the vicinity of the center of the ring and whose arms coincide with radii.

In other words the improvement of the invention consists, in the ring connected to the two straps, in providing an additional V-shaped segment whose vertex coincides with the center of the ring and whose arms form radii.

Advantageously, in practice:

the ring is circular;

the ring and the pins are made of metal, for example steel or aluminum, or even plastic, e.g. having dimensions from rods of a diameter of approximately two to three millimeters;

the ring is spiral-wound and the characteristic V segment is connected to one of the ends of the spiral;

the two arms of the V segment are symmetrical; and if the ring has two pins, the latter slide around the actual ring, whereas if it has only one pin, the latter slides along the V segment.

The way in which the invention may be carried out and the advantages that result therefrom will appear more clearly in the illustrative embodiments that follow with the support of the appended figures.

BRIEF DESCRIPTION OF THE FIGURES

Lastly.

Referring to FIG. 1 showing the approach of the prior art, the device essentially comprises a first strap (1), such as a length of textile braiding for example, attached at one end (2) to the canvas (3) which may be either a ground sheet or a fly sheet. This strap (1) is attached at its other end (4) to a spiral ring (5), made for example from a metal rod. This ring (5) is attached on its other side to a second strap (6), also textile, containing an eyelet (7) through which a peg can be driven into the ground. The ring (5) has two pins (8, 9) for engaging in the hollow female end of the hoop.

DESCRIPTION OF THE PREFERRED EMBODIMENTS

Figure 2:
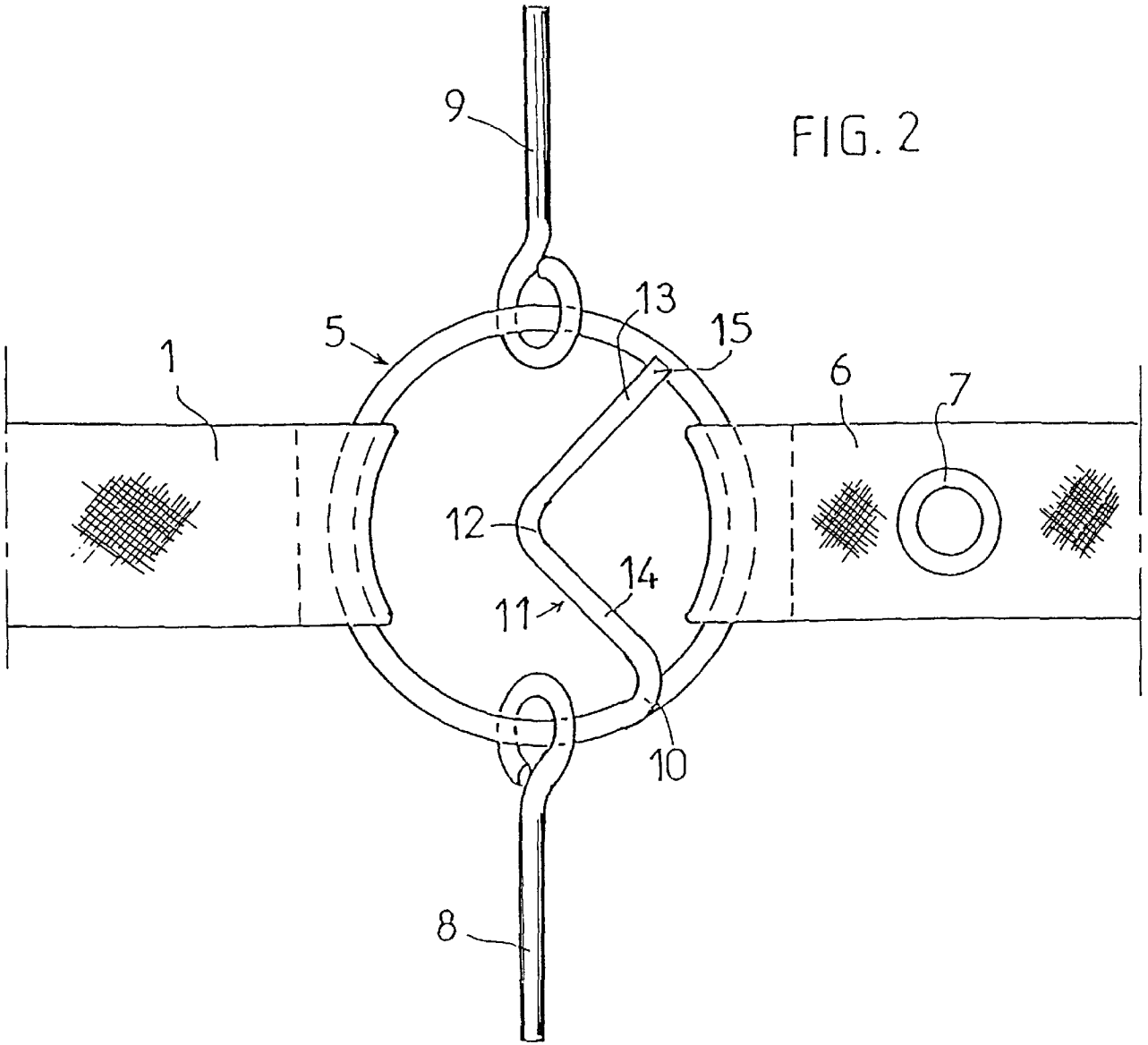
FIG. 2 is an illustration of a device in accordance with the invention in the two-pin version.
Figure 3:
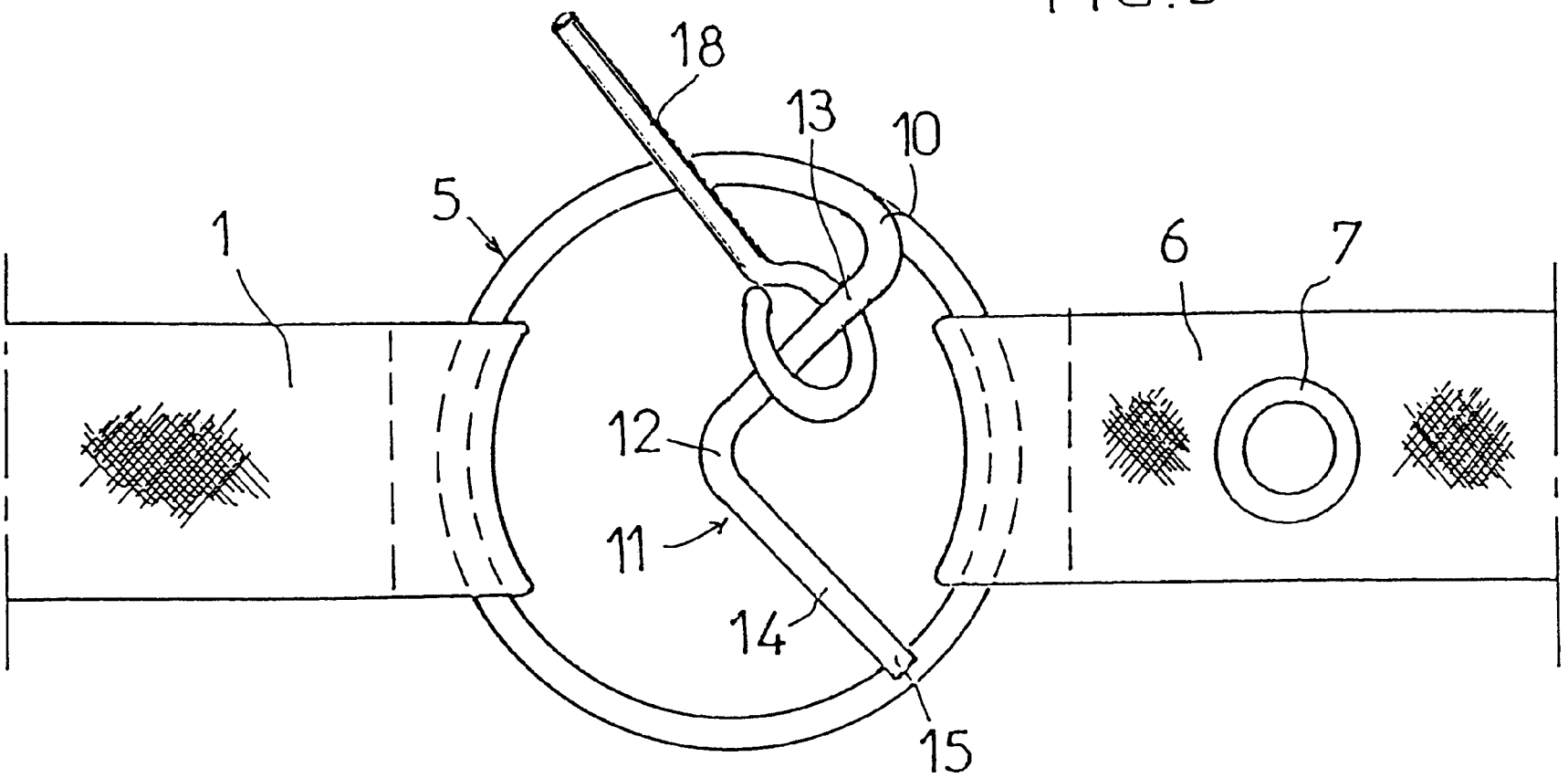
FIG. 3 is an illustration of a device according to the invention in the single-pin version.
Figure 4:
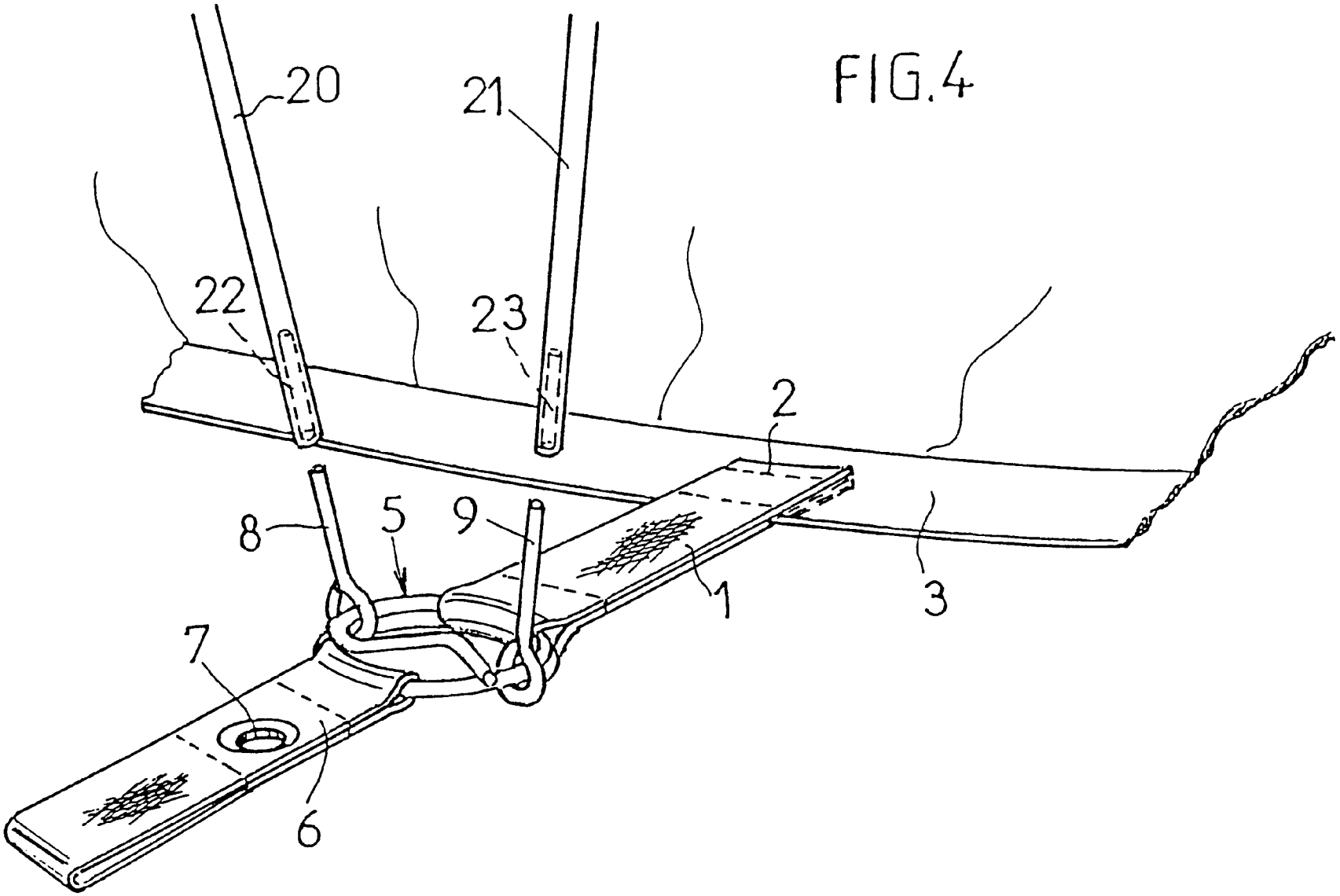
FIG. 4 is a schematic illustration of the device suitable for a two-hoop tent.

For the device according to the invention shown in FIGS. 2–4, the same references are used to denote the same parts. According to the invention, the ring (5) which may be made for example from a metal rod (aluminum, stainless steel etc.), or a rigid plastic, e.g. with a diameter of approximately 3 mm, spiral-wound, is continued at its top end (10) by a V segment denoted by the general reference (11), the vertex (12) of which coincides approximately with the center of the ring while its two arms (13, 14) coincide with radii whose ends (10, 15) meet the ring (5) proper.

In FIG. 4, references (20, 21) denote two hoops whose ends (22, 23) are hollow in order to engage over the pins (8, 9 or 18).

In the first embodiment shown in FIG. 2, the ring (5) has two pins (8, 9) that slide around the ring (5). This solution is particularly suitable (FIG. 4) when two hoops (20, 21) are to end at the same point.

In the solution shown in FIG. 3, the ring (5) has only one pin (18) that slides along the V segment that is a feature of the invention. In this solution, when erected, the pin (18), when inserted into the female part of the hoop, settles in the vertex (12) of the segment (11), thus giving good positioning.

In the solution illustrated in FIG. 2, when erected, the pins (8, 9) settle stably near the ends (10, 15).

Figure 1:
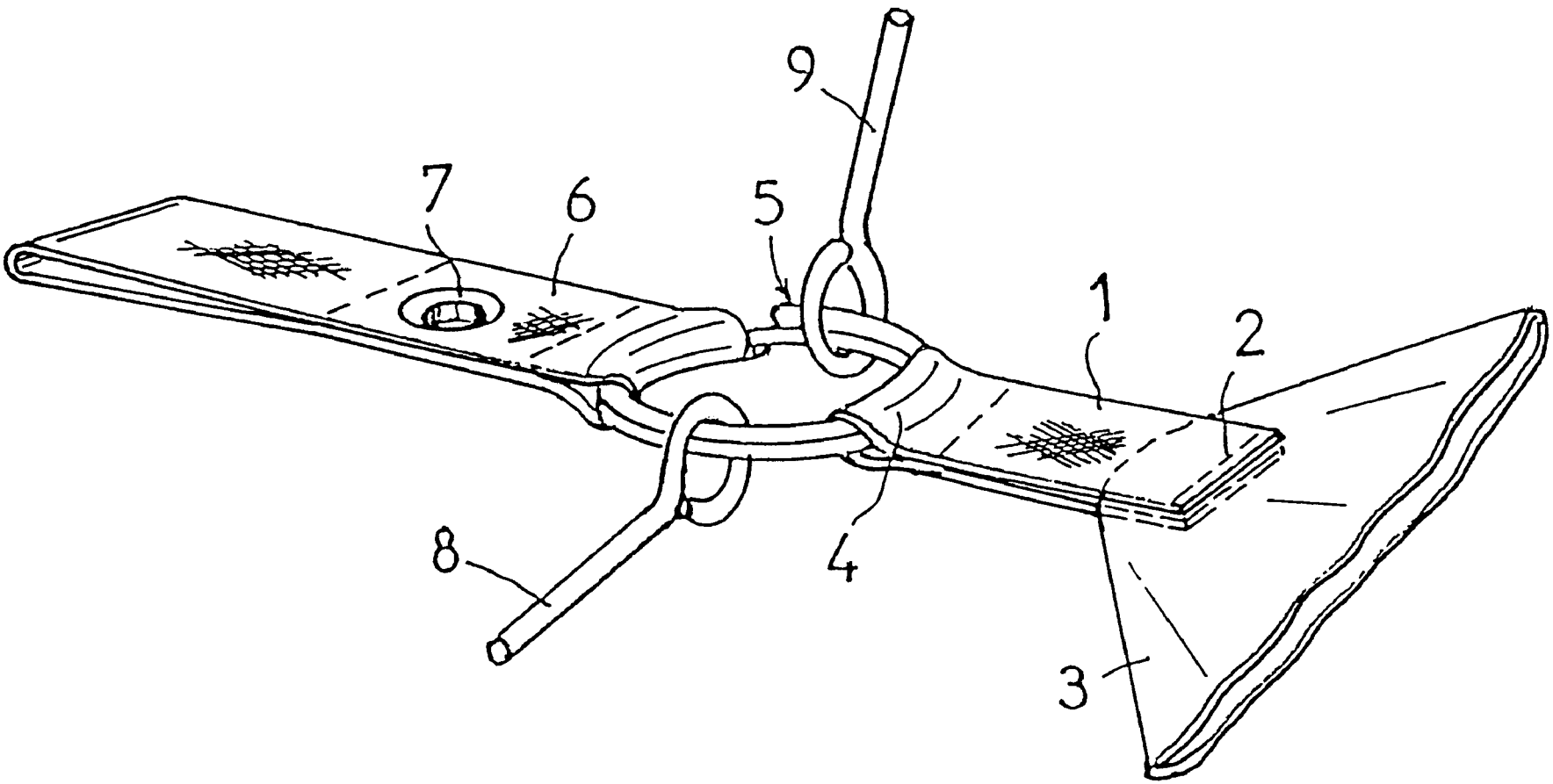
FIG. 1 shows the prior art approach described in the preamble.

The device according to the invention has many advantages over that shown in FIG. 1 illustrating the prior art. The following may be cited:

correct orientation of the pins (8, 9, 18) with respect to the hoop, without interference between them and without causing the straps (1, 6) to become twisted; and the fact that when the pin is inserted in the hoop, the pins are locked either in the center (12) or symmetrically (10, 15), thus contributing to greater stability of the whole.

We claim:

1. Apparatus for attaching hollow ended tent hoops to a ground sheet or the like that includes a first strap attached at one end to the ground sheet and the other end to a ring;

said ring having a V-shaped segment having a vertex that is located at about the center of the ring and arms that coincide with radii of the ring;

a second strap attached to the ring on one side of the V-shaped segment opposite that to which the first strap is attached; and at least one pin mounted on said ring for insertion into the hollow end of a tent hoop.

2. The apparatus of claim 1 wherein said ring is spiral wound and the V-shaped segment is integral with the top spiral of the ring.

3. The apparatus of claim 1 wherein the ring is circular.

4. The apparatus of claim 1 wherein the arms of the V-shaped segment are symmetrical.

5. The apparatus of claim 1 wherein said pin is sidably mounted upon the V-shaped segment.

6. The apparatus of claim 1 wherein two pins are slidably mounted on the body of said ring.

* * * * *

UNITED STATES PATENT AND TRADEMARK OFFICE

CERTIFICATE OF CORRECTION

PATENT NO. : 5,901,726

DATED : May 11, 1999

INVENTOR(S) : Gal et al.

It is certified that error appears in the above—identified patent and that said Letters Patent is hereby corrected as shown below:

On the title page

Please insert Foreign Application Priority Data after

[22] Filed: May 22, 1998

--[30] Foreign Application Priority Data

May 30, 1997 [FR] France .....9706915--

Signed and Sealed this

Thirty-first Day of August, 1999

*Attest:*

Q. TODD DICKINSON

*Attesting Officer*

*Acting Commissioner of Patents and Trademarks*